US007432655B2

(12) United States Patent
Yoo et al.

(10) Patent No.: US 7,432,655 B2
(45) Date of Patent: Oct. 7, 2008

(54) PLASMA DISPLAY PANEL USING COLOR FILTERS TO IMPROVE CONTRAST

(75) Inventors: Sung-Hune Yoo, Asan-si (KR); Tae-Joung Kweon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 372 days.

(21) Appl. No.: 11/390,064

(22) Filed: Mar. 28, 2006

(65) Prior Publication Data

US 2006/0175971 A1 Aug. 10, 2006

Related U.S. Application Data

(63) Continuation-in-part of application No. 10/915,597, filed on Aug. 11, 2004, now Pat. No. 7,109,658.

(30) Foreign Application Priority Data

Aug. 18, 2003 (KR) ..... 2003-56849

(51) Int. Cl.
*H01J 17/49* (2006.01)

(52) U.S. Cl. ..... 313/586; 313/584; 313/585

(58) Field of Classification Search ..... 313/582–587, 313/110–113; 345/37, 41, 60, 71; 315/169.1, 315/169.3

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,757,131 A 5/1998 Tsuchiya (Continued)

FOREIGN PATENT DOCUMENTS

JP 02-148645 6/1990

(Continued)

OTHER PUBLICATIONS

Japanese Office action of Japanese Patent Application No. 2004-163263, mailed on Feb. 7, 2006.

(Continued)

*Primary Examiner*—Joseph L Williams
(74) *Attorney, Agent, or Firm*—Robert E. Bushnell, Esq.

(57) ABSTRACT

A plasma display panel is provided. The plasma display panel includes a front substrate; a rear substrate arranged to face the front substrate, a dielectric layer arranged between the front and the rear substrates and at least a portion of the dielectric layer having a first color, plurality of barrier ribs arranged between the front and the rear substrates and at least a portion of the plurality of barrier ribs having a second color, plurality of light absorbing layers arranged between the front substrate and the plurality of barrier ribs, wherein the first and the second colors are subtractive-mixed with each other. The dielectric layer and the plurality of barrier ribs are colored with two complementary colors that essentially filter out nearly all light. Accordingly, it is possible to reduce outdoor daylight reflection and improve image contrast.

48 Claims, 8 Drawing Sheets

U.S. PATENT DOCUMENTS

| | | | |
|---|---|---|---|
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |
| 2002/0140365 | A1 | 10/2002 | Kobayashi |
| 2003/0034734 | A1 | 2/2003 | Kim et al. |
| 2003/0102803 | A1 | 6/2003 | Chang |
| 2004/0007976 | A1 | 1/2004 | Kao et al. |

FOREIGN PATENT DOCUMENTS

| | | |
|---|---|---|
| JP | 10-208645 | 8/1998 |
| JP | 10-233171 | 9/1998 |
| JP | 2845183 | 10/1998 |
| JP | H10-321143 | 12/1998 |
| JP | 2917279 | 4/1999 |
| JP | 2001-043804 | 2/2001 |
| JP | 2001-325888 | 11/2001 |
| JP | 2002-134034 | 5/2002 |
| JP | 2003-157773 | 5/2003 |
| JP | 2003-168371 | 6/2003 |
| JP | 2003-187708 | 7/2003 |

OTHER PUBLICATIONS

Korean Office action of Korean Patent Application No. 10-2003-0056849, issued on Apr. 27, 2005.

"Final Draft International Standard", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

Japanese Office Action for Japanese Patent Application No. 2004-163263, issued on Nov. 28, 2006.

PLASMA DISPLAY PANEL USING COLOR FILTERS TO IMPROVE CONTRAST

CROSS-REFERENCE TO RELATED APPLICATIONS

This application is a Continuation-in-Part of U.S. patent application Ser. No. 10/915,597 entitled PLASMA DISPLAY PANEL, now U.S. Pat. No. 7,109,658 filed 11 Aug. 2004 in the U.S. Patent & Trademark Office.

CLAIM OF PRIORITY

This application makes further reference to, incorporates the same herein, and claims all benefits accruing under 35 U.S.C §119 from an application entitled PLASMA DISPLAY PANEL filed in the Korean Industrial Property Office on May 24, 2000, and there duly assigned Serial No. 2003-56849 by that Office.

BACKGROUND OF THE INVENTION

1. Field of the Invention

The present invention relates to a plasma display panel (PDP), and more particularly, to a PDP which reduces the brightness of outdoor daylight reflection using a complementary color relationship between a dielectric layer and barrier rib as opposed to using black stripes.

2. Description of the Related Art

In general, a plasma display panel (PDP) displays numbers, characters, or graphics by injecting discharge gas between two substrates with a plurality of electrodes, sealing the two substrates, applying a discharge voltage to the plurality of electrodes, and applying a pulse voltage to address a point where two electrodes intersect when gas is emitted due to the application of the discharge voltage.

A PDP is classified into a direct current (DC) type and an alternate current (AC) type, according to the type of driving voltage applied to a discharge cell, i.e., according to the type of discharge. Also, the plasma display panels may be classified into an opposite discharge type and a surface discharge type according to a configuration of electrodes.

However, in the PDP, bright room contrast is reduced due to the brightness of external light reflected off the PDP.

SUMMARY OF THE INVENTION

The present invention provides a plasma display panel (PDP) with improved contrast.

According to an aspect of the present invention, there is provided a plasma display panel including a front substrate, a rear substrate arranged to face the front substrate, a dielectric layer arranged between the front and the rear substrates and at least a portion of the dielectric layer having a first color, barrier ribs arranged between the front and the rear substrates and at least a portion of the barrier ribs having a second color, light absorbing layers arranged between the front substrate and the barrier ribs, wherein the first and the second colors are subtractive-mixed with each other.

According to another aspect of the present invention, there is provided a plasma display panel including a front substrate, a rear substrate arranged to face the front substrate, a dielectric layer arranged between the front and the rear substrates and at least a portion of the dielectric layer having a first color of a chromatic color, barrier ribs arranged between the front and the rear substrates and at least a portion of the barrier ribs having a second color of a chromatic color which is different from a first color, and light absorbing layers arranged between the front substrate and the barrier ribs.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
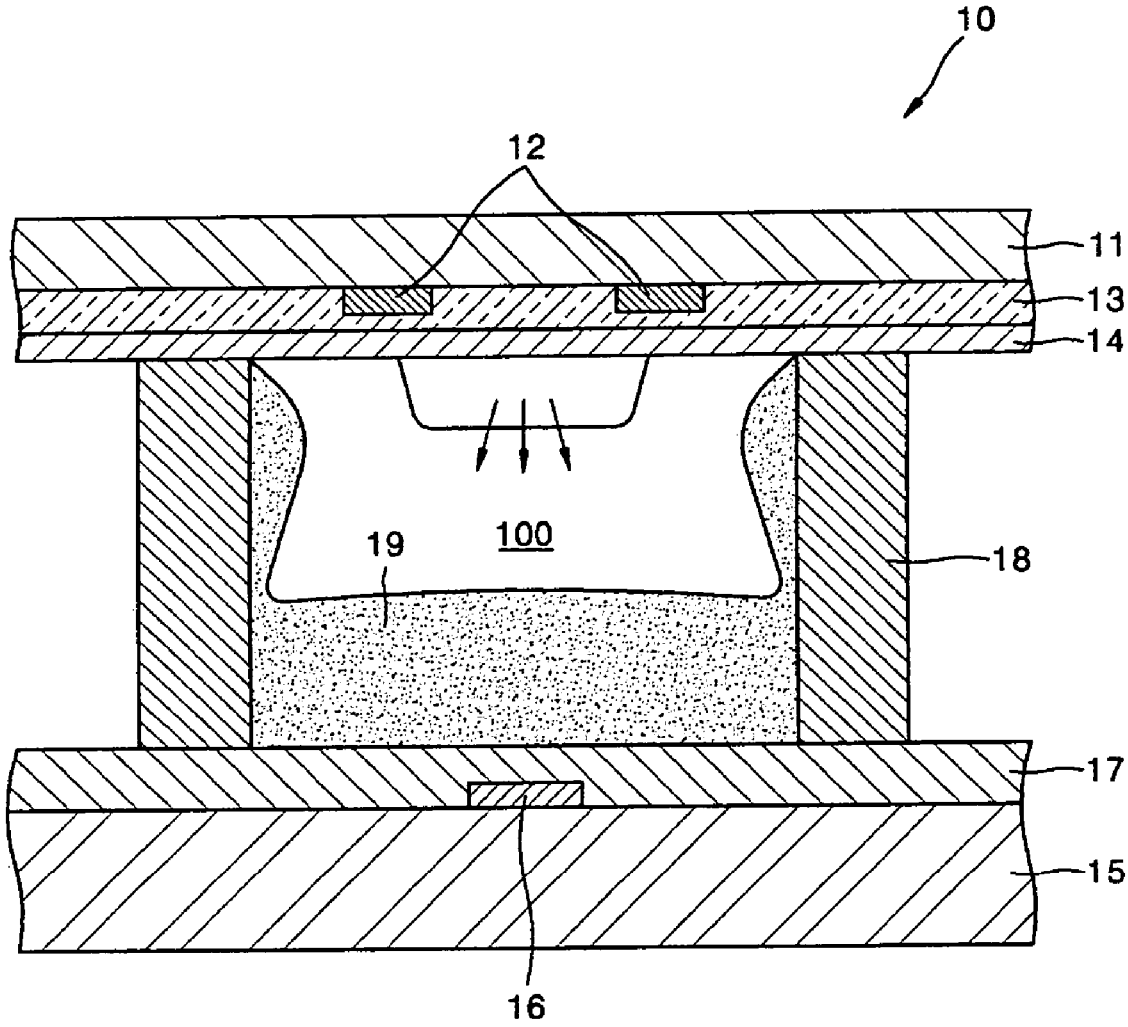
FIG. 1 is a cross-sectional view of a unit cell of a plasma display panel (PDP)

Turning now to the figures, FIG. 1 is a cross-sectional view of a unit cell of a PDP 10. Referring to FIG. 1, the PDP 10 includes a pair of sustaining electrodes 12 on a front substrate 11 and a front dielectric layer 13 covering the pair of sustaining electrodes 12. A surface of the front dielectric layer 13 is coated with a protective layer 14.

Address electrodes 16 are formed on a rear substrate 15 installed to face the front substrate 11, a rear dielectric layer 17 is formed on the address electrodes 16, barrier ribs 18 are formed on the rear dielectric layer 17, and red, green, and blue fluorescent layers 19 are formed to cover an upper surface of the rear dielectric layer 17 and inner sidewalls of the barrier ribs 18. The front substrate 11 is combined with the rear substrate 15, an inert gas is injected into an inner gap between the front and the rear substrates 11 and 15, thus forming a discharge region 100 therebetween.

An operation of the PDP 10 with the above structure will now be briefly described. When a driving voltage is applied to the sustaining electrodes 12, surface discharging is caused on the front dielectric layer 13 and the protective layer 14, thus generating ultraviolet rays. The ultraviolet rays excite a fluorescent material of the fluorescent layer 19, thus displaying colors.

More specifically, the application of the driving voltage accelerates space charges contained in the discharge cell, and the accelerated space charges collide against penning mixture gas contained in the discharge cell at 400-500 Torr of pressure. The penning mixture gas is obtained by adding helium (He) and xenon (Xe) to neon (Ne) that is a main ingredient of the penning mixture gas.

The collision excites the inert gas, thus generating ultraviolet rays of 147 nanometers. The generated ultraviolet rays collide against the fluorescent material of the fluorescent layer 19 coated onto the address electrode 16 and the barrier ribs 18, thus generating visible rays.

Figure 2:
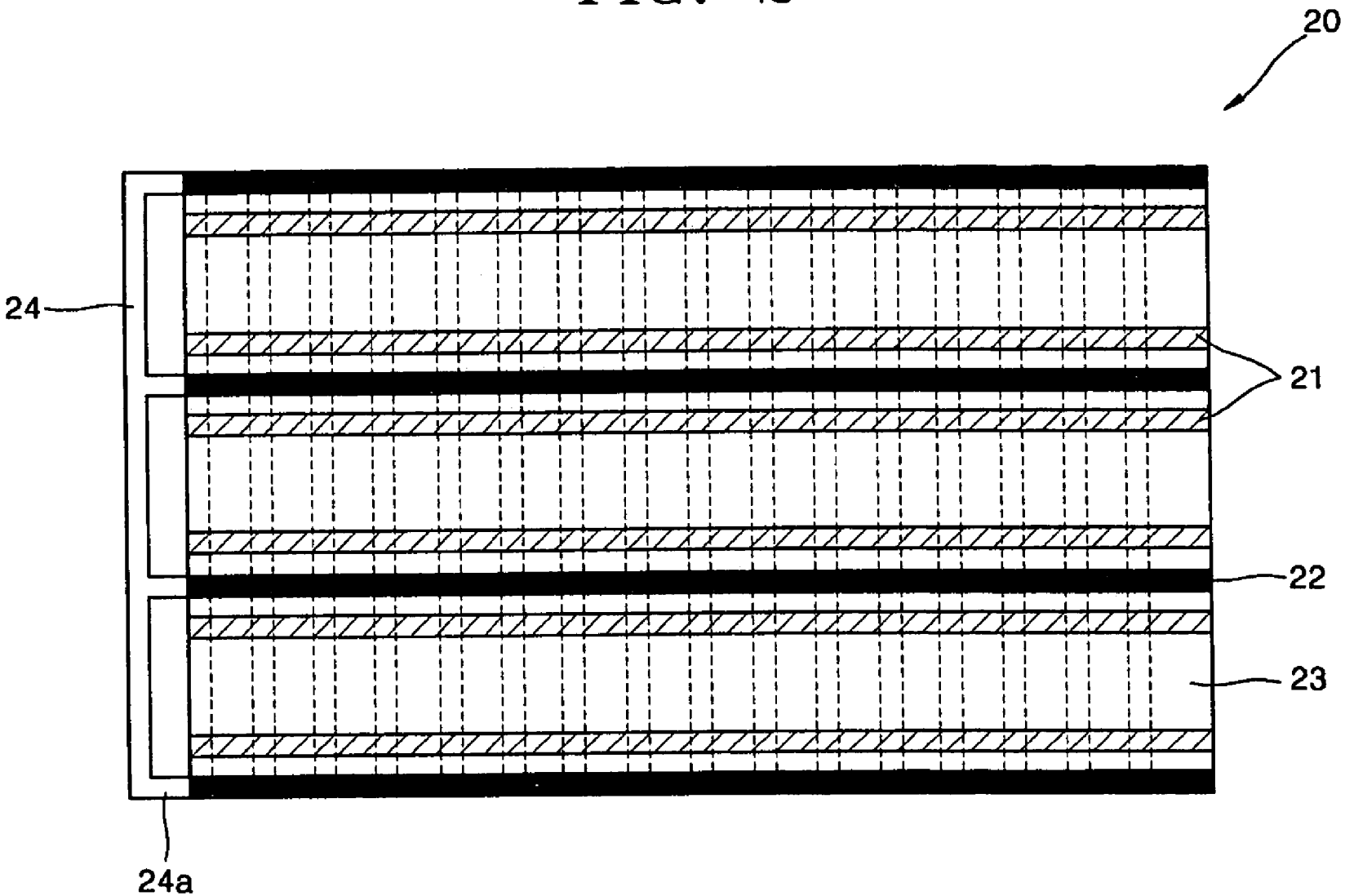
FIG. 2 is a plan view of a PDP.

FIG. 2 illustrates plan view of a PDP 20. Referring to FIG. 2, plural pairs of bus electrodes 21 are arranged in stripes on a front substrate of the PDP 20 at predetermined intervals, and black stripes 22 are positioned in non-discharge regions between the respective pairs of the bus electrodes 21. The bus electrodes 21 and the black stripes 22 are covered with a transparent dielectric layer 23. Also, matrix type barrier ribs 24 are formed on a rear substrate of the PDP 20. The barrier ribs 24 are white and their horizontal barrier ribs 24*a* are arranged to overlap with the respective black stripes 22 when the front and the rear substrates are combined.

Figure 3:
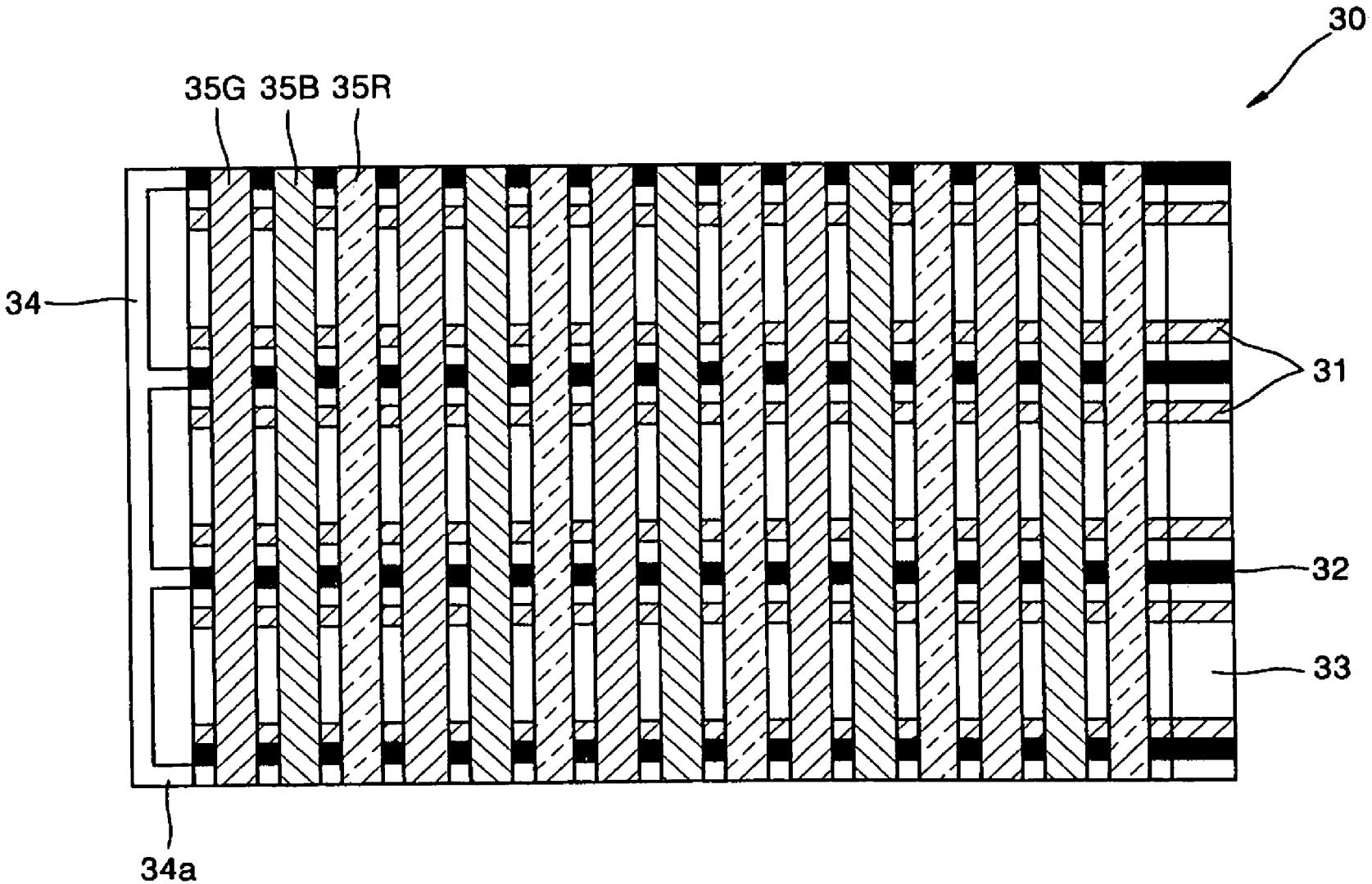
FIG. 3 is a plan view of a type of PDP.

FIG. 3 illustrates a plan view of another type of a PDP 30. Referring to FIG. 3, plural pairs of bus electrodes 31 are arranged in stripes on a front substrate of the PDP 30 at predetermined intervals, and black stripes 32 are positioned in non-discharge regions between the respective pairs of the bus electrodes 31. The bus electrodes 31 and the black stripes 32 are covered with a transparent dielectric layer 33. Also, matrix type barrier ribs 34 are formed on a rear substrate of the PDP 30. The barrier ribs 34 are white and horizontal barrier ribs 34*a* are formed to overlap with the respective black stripes 32 when the front and the rear substrates are combined. Red, green, and blue filters 35R, 35G, and 35B are arranged perpendicularly to the bus electrodes 31.

Figure 4:
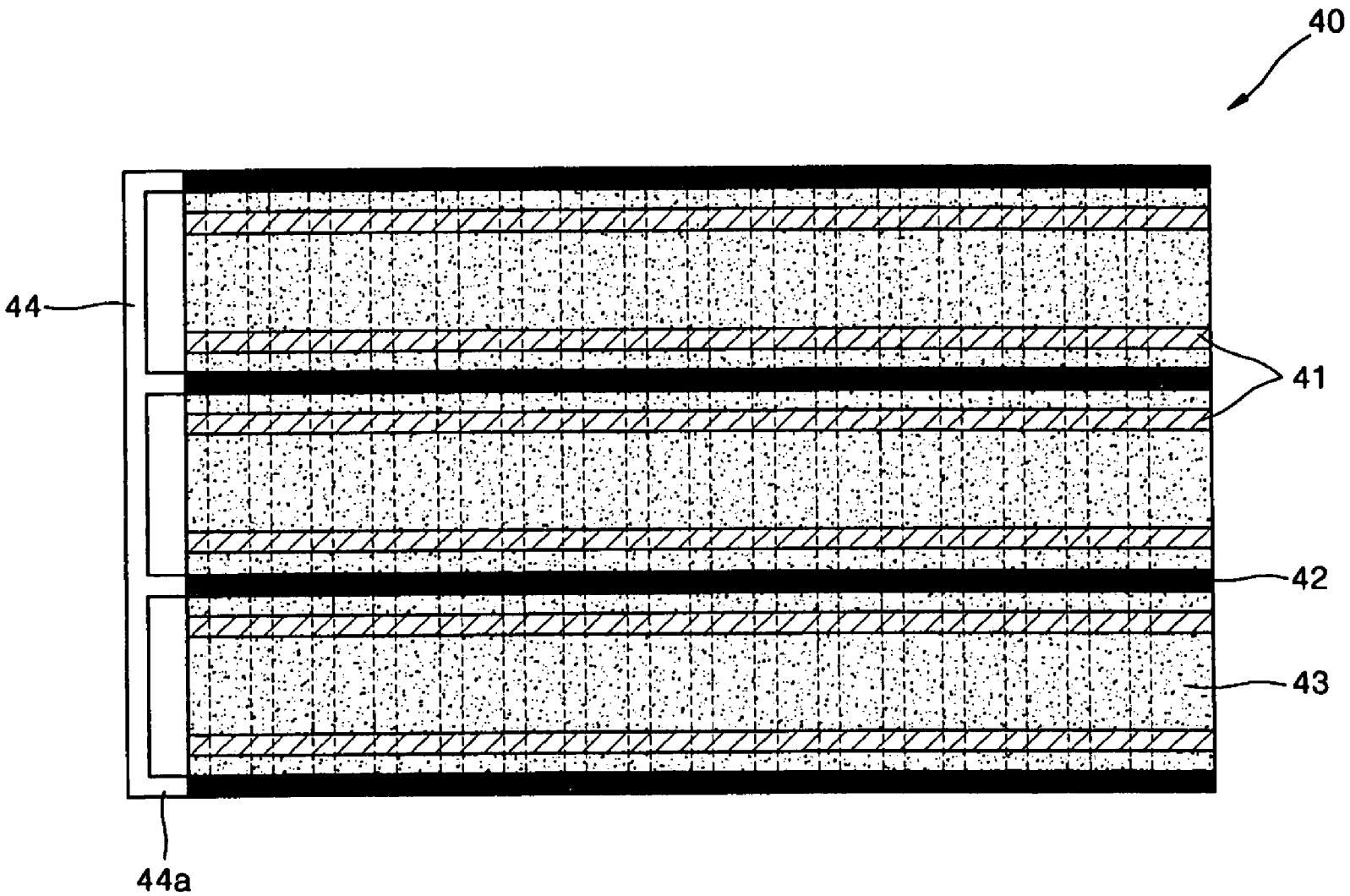
FIG. 4 is a plan view of another type of PDP.

FIG. 4 illustrates characterization portions of yet another type of PDP 40. Referring to FIG. 4, plural pairs of bus electrodes 41 are arranged in stripes on a front substrate of the PDP 40 at predetermined intervals, and black stripes 42 are positioned in non-discharge regions between the respective pairs of the bus electrodes 41. The bus electrodes 41 and the black stripes 42 are covered with a colored dielectric layer 43. Also, matrix type barrier ribs 44 are formed on a rear substrate of the PDP 40. The barrier ribs 44 are white and their horizontal barrier ribs 44*a* are formed to overlap with the respective black stripes 42 when the front and the rear substrates are combined.

Figure 5:
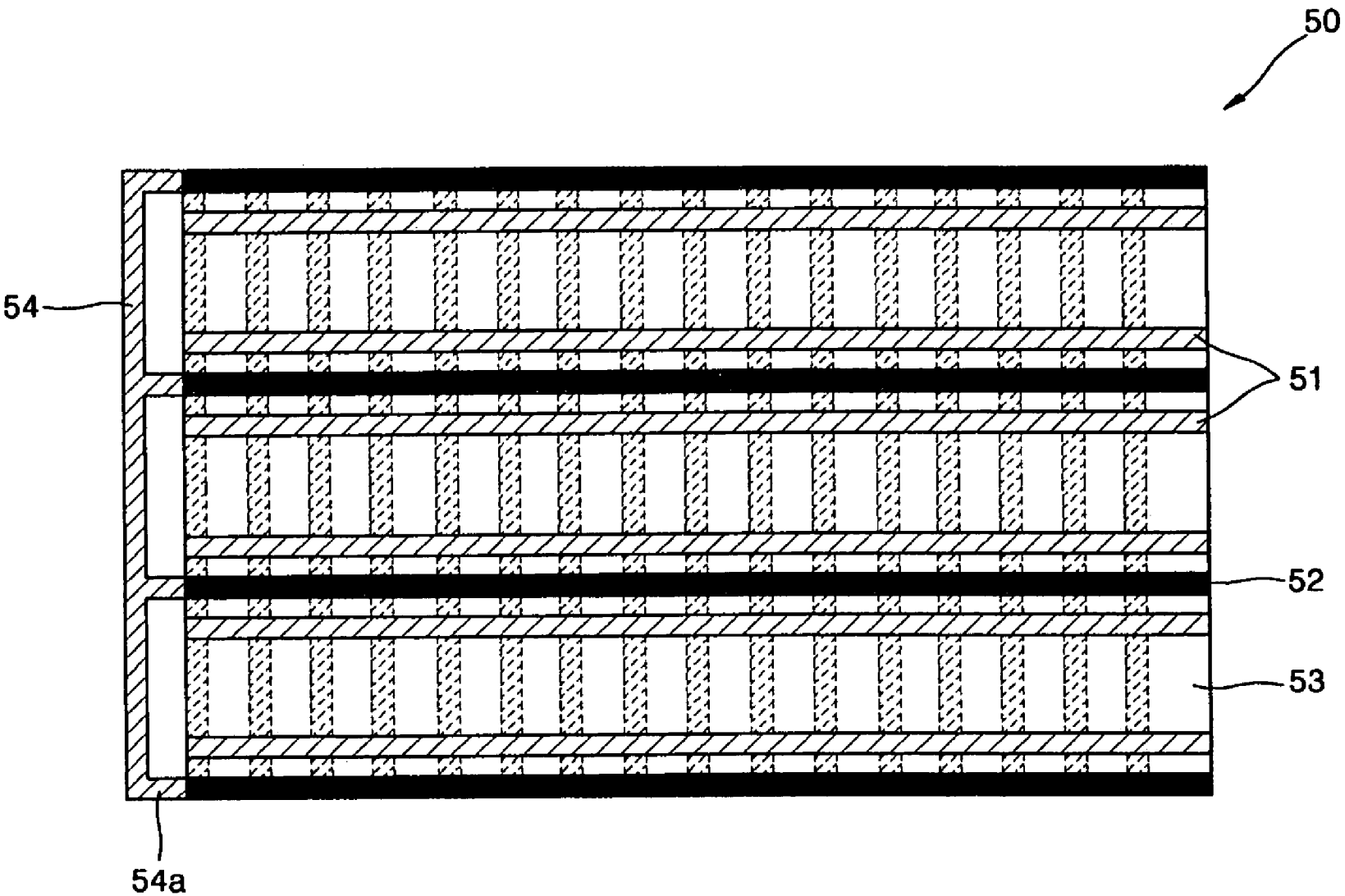
FIG. 5 is a plan view of yet another type of PDP.

FIG. 5 illustrates a plan view of still another type of PDP 50. Referring to FIG. 5, plural pairs of bus electrodes 51 are arranged in stripes on a front substrate of the PDP 50 at predetermined intervals, and black stripes 52 are positioned in non-discharge regions between the respective pairs of the bus electrodes 51. The bus electrodes 51 and the black stripes 52 are covered with a transparent dielectric layer 53. Also, matrix type barrier ribs 54 are formed on a rear substrate of the PDP 50. The barrier ribs 54 are black and horizontal barrier ribs 54*a* are formed to overlap with the respective black stripes 52 when the front and the rear substrates are combined.

A PDP such as that shown in FIGS. 2 through 5 have the following disadvantages. First, in these PDPs, opaque bus electrodes and black stripes are patterned to reduce outdoor daylight reflection and improve contrast. However, there is a limitation to reducing outdoor daylight reflection when only black stripes are patterned. Second, installation of red, green, and blue filters in red, green, and blue discharge cell is further required to increase degree of color purity. Third, when using only a colored dielectric layer to reduce the outdoor daylight reflection, a rate of reducing the outdoor daylight reflection is limited. Fourth, a PDP adopts barrier ribs with black upper sides for reducing the brightness of reflection, but use of such barrier ribs substantially reduces the brightness of reflection by 10 or more percentages.

Figure 6:
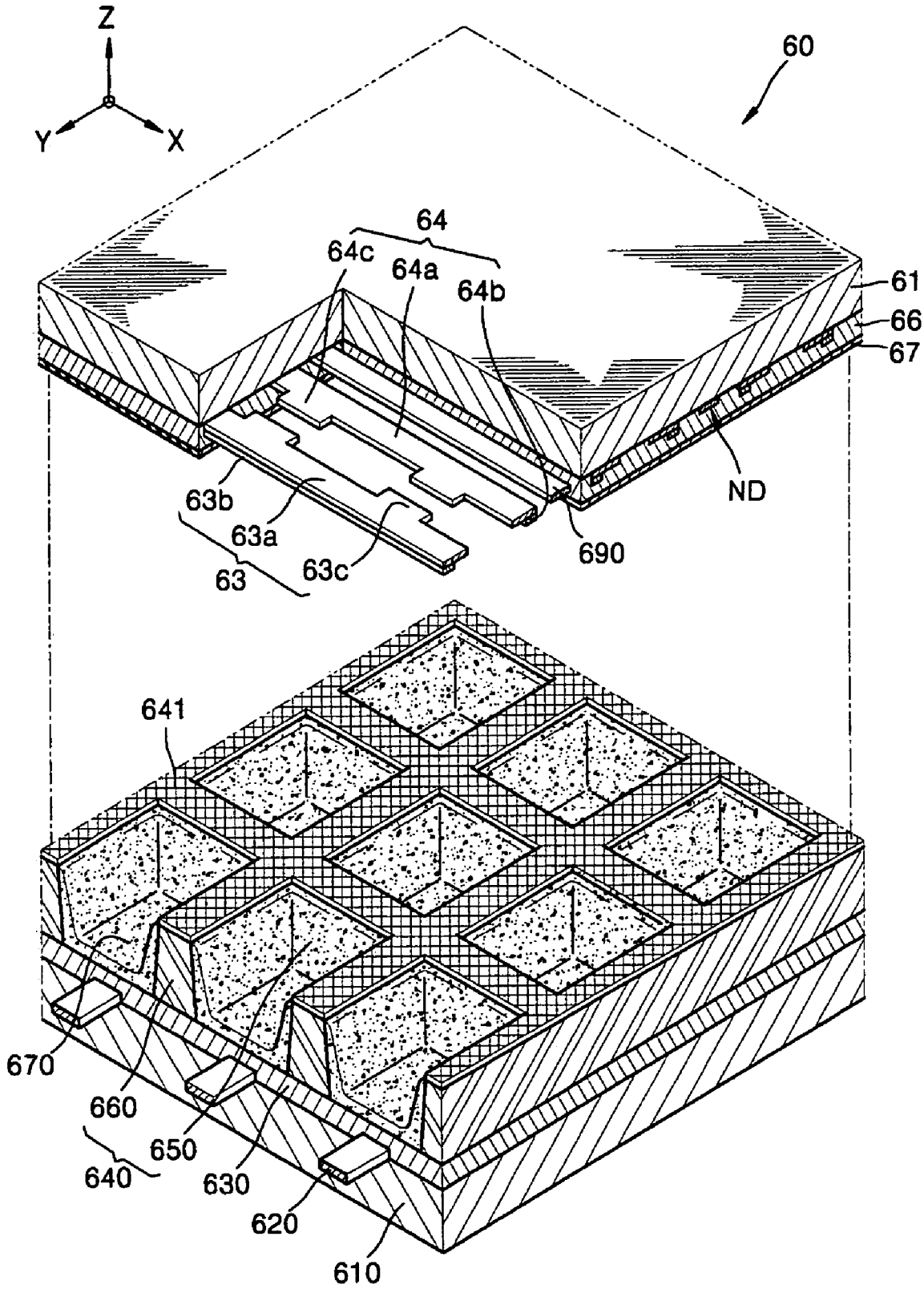
FIG. 6 is an exploded perspective view of a PDP according to an embodiment of the present invention.

Referring to FIG. 6, a plasma display panel (PDP) 60 according to an embodiment of the present invention is illustrated and includes a front substrate 61 and a rear substrate 610 which is disposed to face the front substrate 61. Also, multiple pairs of sustain electrodes 65 are arranged in parallel on the front substrate 61. Each pair of the sustain electrodes 65 is comprised of an X electrode 63 and a Y electrode 64. The X electrodes 63 and the Y electrodes 64 are alternately arranged at the bottom of the front substrate 61 along an x-direction on the front substrate 61. The X electrode 63 includes a first transparent electrode 63*a* and a stripe type first bus electrode 63*b* formed along an edge of the first transparent electrode 63*a*. Similarly, the Y electrode 64 includes a second transparent electrode 64*a* and a stripe type second bus electrode 64*b* formed along an edge of the second transparent electrode 64*a*.

The first and the second transparent electrodes 63*a* and 64*a* are formed of a transparent conductive film such as an Indium Tin Oxide (ITO) film. The first and the second bus electrodes 63*b* and 64*b* are formed of a metal material with high electrical conductivity such as Ag paste, Cr—Cu—Cr, or Al.

A pair of the X and Y electrodes 63 and 64 are positioned in each discharge cells A predetermined sized first projected electrode 63*c* is extended to an inner wall of the first transparent electrode 63*a*, projecting in a discharge cell toward the second transparent electrode 64*a*. A predetermined sized second project electrode 64*c* is extended to an inner wall of the second transparent electrode 64*a*, projecting in a discharge cell toward the first transparent electrode 63*a*.

The shapes of the X and Y electrodes 63 and 64 or their arrangements in a discharge cell are not limited to the above description. In other words, when the X and Y electrodes 63 and 64 are arranged to face each other, their shapes or arrangements may be variously determined. In this disclosure, a region between a pair of the X and Y electrodes 63 and 64 and another pair of the X and Y electrodes 63 and 64 will be referred to as Non-Discharge (ND) region.

A front dielectric layer 66 is formed on a base of the front substrate 61 to cover the X and Y electrodes 63 and 64. An upper surface of the front substrate 61 is completely coated with the front dielectric layer 66. A surface of the front dielectric layer 66 is coated with a protective layer 67 such as a magnesium oxide.

Address electrodes 620 are formed on the rear substrate 610 at predetermined intervals and run in the y-direction orthogonal to the X electrodes 63 and the Y-electrodes 64. Also, the address electrodes 620 are arranged to intersect the X and Y electrodes 63 and 64. A rear dielectric layer 630 is formed on the address electrodes 620 to cover the address electrodes 620.

Barrier ribs 640 are disposed on the rear dielectric layer 630 to define discharge cells and prevent crosstalk between the discharge cells. The barrier ribs 640 include first barrier ribs 650 formed in the x-direction perpendicular to the address electrodes 620 and the second ribs 660 formed in the y-direction parallel with the address electrodes 620. The second ribs 660 are extended to both sides of the first barrier ribs 650, thus forming a matrix structure. However, if the discharge cells are defined by the barrier ribs 640, the barrier ribs 640 are not limited to the illustrated matrix structure. Alternatively, the barrier ribs 640 may be formed as a meander type, a honeycomb type, a delta type, or a stripe type. An upper portion of the rear dielectric layer 630 and inner sidewalls of the barrier ribs 640, which form the discharge cells, are covered with red, green, and blue fluorescent layers 670. A PDP, such as the PDP 60 according to the present invention is capable of reducing the brightness of outdoor daylight reflection without using black stripes, but instead using a complementary color relationship between a dielectric layer 66 and barrier ribs 640 based on subtractive mixing.

Figure 7:
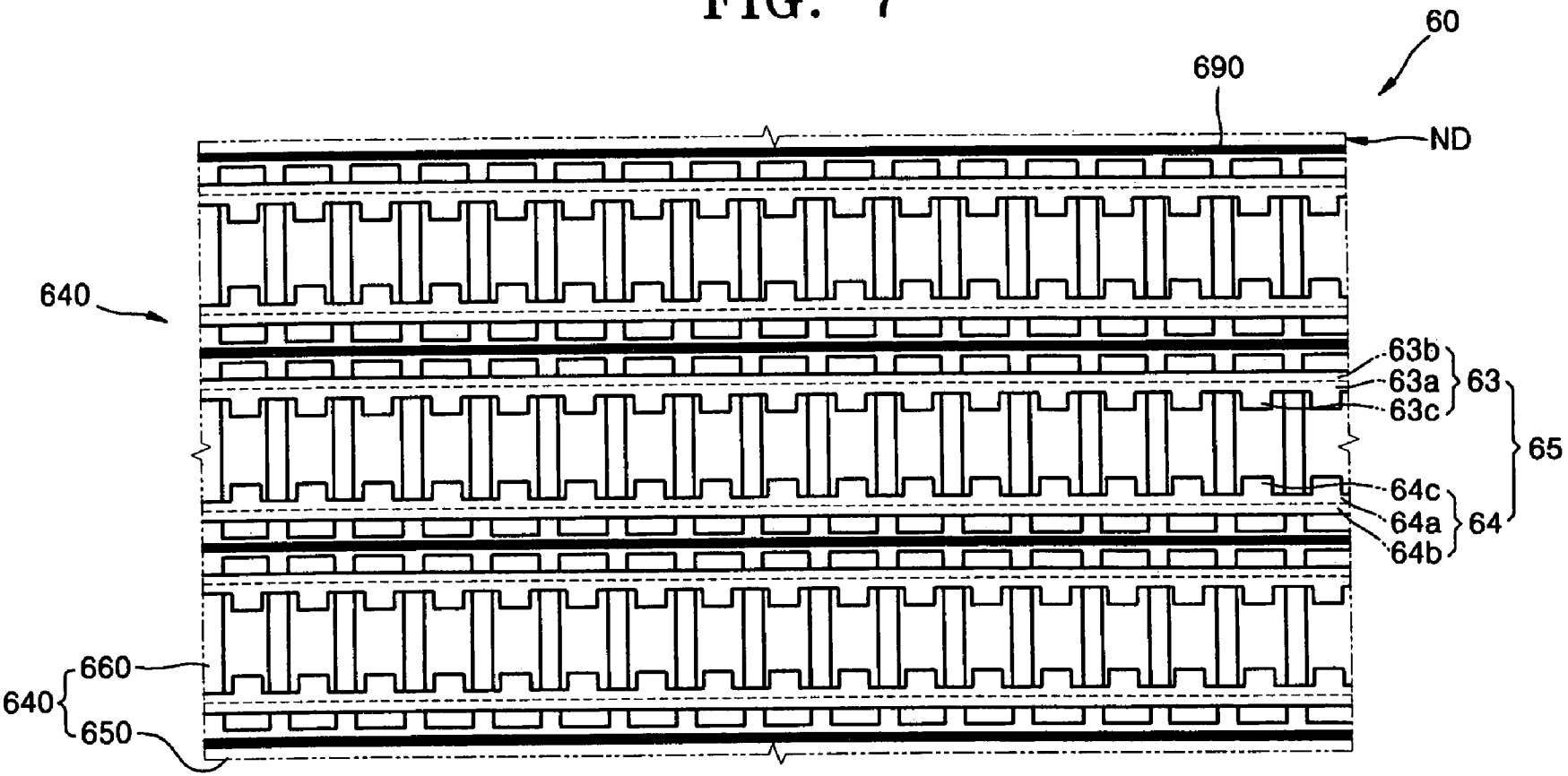
FIG. 7 is a schematic plan view illustrating an arrangement in which X electrodes, Y electrodes, barrier ribs, and light absorbing layers are deposited.

More specifically, as shown in FIG. 7 illustrating characterization portions of the PDP 60 of FIG. 6, the X and Y electrodes 63 and 64 are disposed at a rear side of the front substrate 61 of FIG. 6. The X and Y electrodes 63 and 64 are covered with the front dielectric layer 66. The matrix-type barrier ribs 640 are disposed on the rear substrate 610. The first barrier ribs 650 are arranged in parallel with the X and Y electrodes 63 and 64, and the second barrier ribs 660 are arranged perpendicularly to the X and Y electrodes 63 and 64.

Light absorbing layers 690 are formed between the adjacent sustain electrodes 65. The light absorbing layers 690 absorb external incident visible light and reduce the reflection brightness thereof. The light absorbing layers 690 may be black, thus reducing the reflection of external light. Also, the light absorbing layers 690 may be formed of various materials, and preferably, an oxide containing Ag, Cr, and Al. To simplify a manufacturing process, the light absorbing layers 690 may be fabricated during manufacture of the bus electrodes 63*b* and 64*b*. The light absorbing layers 690 may be arranged at various locations. For example, the light absorbing layers 690 may be arranged to face the barrier ribs (640) as illustrated in FIG. 7. That is, the light absorbing layers 690 are arranged in a non-discharge region (ND) so that visible light generated in a discharge cell is not absorbed by the light absorbing layers 690. The shapes of the light absorbing layers 690 are not limited, for example, they may be patterned in stripes. The front dielectric layer 66 and the barrier ribs 640 are colored using subtractive mixing. Therefore, a region in which the front dielectric layer 66 and the barrier ribs 640 overlap each other appears darker than other regions. In particular, when the front dielectric layer 66 and the barrier ribs 640 have complementary colors with each other, the color of the region in which they overlap each other appears as near black. Also, the front dielectric layer 66 and the barrier ribs 640 may be colored with chromatic colors, thus realizing subtractive mixing for effective reduction of the brightness and chroma of outdoor daylight reflection.

In the color display art, all colors can be made out of a combination of additive primaries red, green and blue (R), (G) and (B). Alternatively, the colors can be made out of the subtractive primaries of magenta, yellow and cyan (M), (Y) and (C). The subtractive primaries can be formed by adding together two different additive primaries. For example, (R) plus (G) results in (Y), (B) plus (G) results in (C) and (B) plus (R) results in (M). Similarly, the additive primaries can be derived by mixing together two subtractive primaries. (R) can be formed by mixing (M) and (Y). (B) can be formed by mixing (M) and (C). (G) can be formed by mixing (Y) and (C). In yet another alternative color scheme, (R), (Y) and (B) are primary colors and orange (O), (G) and violet (V) are the secondary colors.

Figure 8:
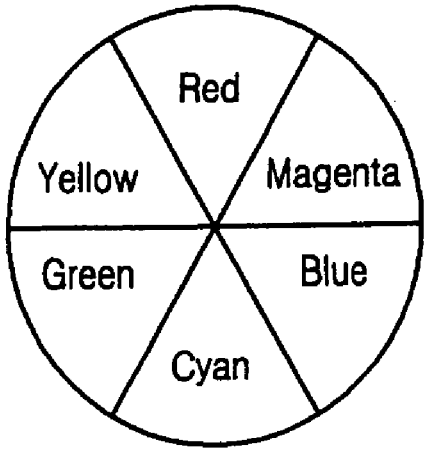
FIG. 8 illustrates a color wheel for a RGBCYM color scheme.

A color wheel or a color circle can be formed for each of these color schemes. In a clockwise direction, a color wheel as illustrated in FIG. 8 is made out of (R), (M), (B), (C), (G) and (Y). Colors diametrically opposite from each other on the color wheel are called complementary colors. In other words, (R) and (C) are complements of each other, (M) and (G) are complements of each other and (Y) and (B) are complements of each other for the color wheel of FIG. 8.

Figure 9:
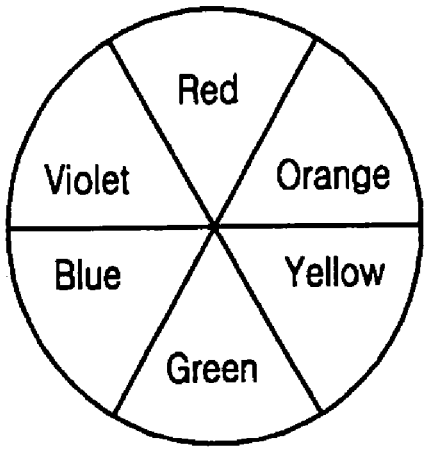
FIG. 9 illustrates a color wheel for a RYB and OGV color scheme that produces complementary color pairs that filter out nearly all light.

In another color scheme, the primary colors are (R), (B) and (Y) instead of (R), (B) and (G). Secondary colors are then formed by mixing together two primary colors, thus producing orange (O), violet (V) and green (G). In this alternative color scheme, a color wheel as illustrated in FIG. 9 can be formed by having the colors (R), (O), (Y), (G), (B), and (V) in a clockwise direction. (O) is positioned between (R) and (Y) and is formed by mixing (R) and (Y). Similarly, (G) is positioned between (B) and (Y) and is formed by adding (B) and (Y). (V) is positioned between (R) and (B) and is formed by mixing (R) and (B). As in the color wheel of FIG. 8, colors diametrically opposite from each other on the color wheel of FIG. 9 are considered complements of each other. In this color scheme, (G) is a complement of (R), (O) is a complement of (B), and (V) is a complement of (Y) as each of these pairs of colors resides diametrically opposite from each other on the color wheel. For each of these three complementary pairs in FIG. 9, when mixed, forms essentially black. The present invention exploits this feature of complementary pairs of colors in the color wheel of FIG. 9.

The present invention employs subtractive mixing. In subtractive mixing, a partially transparent filter is used to filter out one color component of impinging light while transmitting the other colors. When two partially transparent filters are placed in series, two color components are filtered out of impinging light and the remainder is transmitted. Typically, when three filters are placed in series, and each of the three filters are a primary color, no light will be transmitted as all of the light is absorbed. Thus, if a (C), (M) and (Y) filter are placed in series, no light is transmitted. Or, if (R), (G) and (B) filters are placed in series, no light is transmitted. The present invention exploits the complementary color scheme of FIG. 9 to produce essentially no transmitted light with the use of just two filters by subtracting out of incoming light just two colors instead of three to form near black.

In the subtractive mixing, a color is produced by subtracting a color element from white incident light. Primary three colors are magenta (M), yellow (Y), and cyan (C), and an achromatic color such as gray or black is obtained by mixing a complementary pair of colors, e.g., mixing red with green or mixing blue with orange or by mixing violet and yellow. In a combination of complementary colors, the respective primary three colors may be matched with their counterparts of complementary colors or various complementary pairs of colors may be selected. Subtractive mixing results in a reduction in the brightness and saturation of the original colors. In detail, mixing of adjacent colors in the color circle of FIG. 9 produces an intermediate color between the adjacent colors, mixing of colors at a long distance in the color circle reduces the brightness and saturation of the original colors, thus producing near-gray, and mixing of complementary colors produces near-black. The subtractive mixing uses absorption, selective transmission, or reflection of light. That is, in general, red, green, and blue are absorbed in the subtractive mixing. The absorption of such colors can be observed by installing filters of various colors along the optical path of a white ray.

Turning back to the novel PDP 60 of the present invention, the front dielectric layer 66 and the barrier ribs 640 are colored using the subtractive mixing. More particularly, upper portions 641 of the barrier ribs 640, shown in FIG. 6, are colored with a high-reflection non-black color, thereby preventing a reduction in the brightness of light emitted from the red, green, and blue fluorescent layers 670 and preventing the light from being lost in the barrier ribs 640. Also, the front dielectric layer 66 is colored with a color that minimizes a reduction in the transmissivity of the emitted light.

Also, the upper portion 641 of the barrier rib 640 and the front dielectric layer 66 are colored with complementary colors from the color wheel of FIG. 9 so as to reduce outdoor daylight reflection, thus improving contrast. For instance, the upper portion 641 may be colored with orange (O) that is a high-reflection color and the front dielectric layer 66 is colored with blue (B) that is a complementary color of orange (O). The brightness of the colored front dielectric layer 66 is higher than that of the colored barrier rib 640. Alternatively, the entire barrier ribs 640 and not just the top portions 641 are colored. In one embodiment, only non-discharge (ND) regions of dielectric layer 66 are colored and the remaining portions of dielectric layer 66 that correspond to discharge cells are transparent. The non-discharge regions essentially correspond to portions of dielectric layer 66 in contact with barrier ribs 640. Alternatively, in another embodiment, the entire dielectric layer 66 is colored, including discharge and non-discharge regions. This later embodiment where the entire dielectric layer 66 is colored is possible because the brightness of the plasma display panel at present is very high and thus it does not matter if portions of dielectric layer 66 that correspond to a discharge regions are colored.

Now, a process for making the PDP 60 will be discussed. In the PDP 60 with the above structure, a raw material for barrier ribs 640 is applied evenly onto the rear substrate 610. In the embodiment where only an upper portion 641 only of barrier ribs 640 is colored, a raw material for transparent barrier ribs is first applied. Then, a raw material for the colored portion 641 of the barrier ribs is applied evenly on top of the raw material for the transparent portion. Both raw material layers of the transparent and the colored portions are sandblasted together in a single sandblasting step. In the embodiment where the entire barrier rib structure is colored, the raw material for the colored barrier ribs only is applied without applying a transparent raw material layer. In either embodiment, after applying all the raw material layers for the barrier ribs, a photosensitive photoresist that is highly resistant to sand blasting is coated onto the rear substrate 610 covered with the raw barrier rib material(s).

Next, a photo mask, which has a pattern corresponding to a desired barrier rib pattern, is disposed on the photoresist-coated upper portion of the material for barrier ribs, and the photoresist is exposed with ultraviolet rays to form the desired barrier rib pattern thereon. The exposed portions of the photoresist are chemically stabilized and developed, thus obtaining the barrier rib pattern, upper portions of which are colored.

Next, an abrasive is sprayed onto a resultant structure via a nozzle of a sand blast apparatus containing the abrasive, under a high pressure. Then, portions of the material for barrier ribs, which are not attached with the photoresist, are removed from the resultant structure due to the force of spraying the abrasive. Thereafter, the photoresist is peeled off from the resultant structure, and the remaining material for barrier ribs are sintered thus completing the barrier ribs 640.

As described above, a PDP according to the present invention has the following advantages. First, external light can be absorbed by light absorbing layers, a dielectric layer and barrier ribs are colored using subtractive mixing, thus reducing the brightness of outdoor daylight reflection and improving contrast. Second, the present invention allows a user to combine colors of the dielectric layer and the barrier ribs as the user desires. Third, barrier ribs are colored with a high-reflection color, thereby preventing loss of light emitted from the red, green, and blue fluorescent layers. Fourth, since the present invention adopts matrix-type barrier ribs, it is possible to use portions of non-discharge regions for reducing outdoor daylight reflection, thereby improving contrast. Fifth, it is possible to reduce outdoor daylight reflection by coloring the dielectric layer with colored barrier ribs using subtractive mixing while increasing the transmissivity of the dielectric layer While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A plasma display panel, comprising:

a front substrate;

a rear substrate arranged to face the front substrate;

a dielectric layer arranged between the front and the rear substrates, at least a portion of the dielectric layer having a first color;

a plurality of barrier ribs arranged between the front and the rear substrates, at least a portion of the plurality of barrier ribs having a second color; and a plurality of light absorbing layers arranged between the front substrate and the plurality of barrier ribs, wherein the first color and the second color are subtractive-mixed with each other.

2. The plasma display panel of claim 1, wherein the first color and the second color are complementary colors with respect to each other.

3. The plasma display panel of claim 1, wherein a portion of the dielectric layer that overlaps with the plurality of barrier ribs appears as a third color that is darker than each of the first and the second colors.

4. The plasma display panel of claim 3, wherein the third color is near black.

5. The plasma display panel of claim 1, wherein a brightness of the first color is greater than a brightness of the second color.

6. The plasma display panel of claim 1, wherein the dielectric layer is entirely colored.

7. The plasma display panel of claim 1, wherein only upper portions of the plurality of barrier ribs are colored.

8. The plasma display panel of claim 1, wherein the plurality of barrier ribs are entirely colored.

9. The plasma display panel of claim 1, wherein the dielectric layer is arranged between the front substrate and the plurality of barrier ribs.

10. The plasma display panel of claim 1, wherein at least a portion of the plurality of light absorbing layers is arranged to correspond to the plurality of barrier ribs.

11. The plasma display panel of claim 1, wherein the plurality of light absorbing layers are arranged in stripes.

12. The plasma display panel of claim 1, wherein the plurality of light absorbing layers are near black.

13. The plasma display panel of claim 1, wherein the plurality of light absorbing layers are arranged within the dielectric layer.

14. The plasma display panel of claim 1, further comprising a plurality of X electrodes and a plurality of Y electrodes arranged on the front substrate and covered by the dielectric layer.

15. The plasma display panel of claim 14, wherein the plurality of X electrodes and the plurality of Y electrodes are alternately arranged.

16. The plasma display panel of claim 14, further comprising:

a plurality of address electrodes arranged between the front and the rear substrates and intersecting the plurality of X electrodes and the plurality of Y electrodes; and a plurality of fluorescent layers arranged within a plurality of discharge cells defined by the plurality of barrier ribs.

17. The plasma display panel of claim 14, wherein each X electrode comprises a first transparent electrode and a first bus electrode electrically connected to the first transparent electrode, and each Y electrode comprises a second transparent electrode and a second bus electrode electrically connected to the second transparent electrode.

18. The plasma display panel of claim 17, wherein each X electrode further comprises a first project electrode that is transparent and extends from the first transparent electrode toward the second transparent electrode and each Y electrode further comprises a second project electrode that is transparent and extends from the second transparent electrode toward the first transparent electrode.

19. The plasma display panel of claim 17, wherein the first and the second transparent electrodes each comprise indium tin oxide.

20. The plasma display panel of claim 17, wherein each first bus electrode and each second bus electrode comprises a material selected from the group consisting of Ag, Cr, Cu, and Al.

21. The plasma display panel of claim 1, wherein the plurality of barrier ribs are a matrix type.

22. A plasma display panel, comprising:

a front substrate;

a rear substrate arranged to face the front substrate;

a dielectric layer arranged between the front and the rear substrates, at least a portion of the dielectric layer being a first chromatic color;

a plurality of barrier ribs arranged between the front and the rear substrates, at least a portion of the plurality of barrier ribs being a second chromatic color that is different from the first chromatic color; and a plurality of light absorbing layers arranged between the front substrate and the plurality of barrier ribs.

23. The plasma display panel of claim 22, wherein the first chromatic color and the second chromatic color are complementary colors with respect to each other.

24. The plasma display panel of claim 22, wherein a portion of the dielectric layer that overlaps with the plurality of barrier ribs appears as a third chromatic color that is darker than each of the first and the second chromatic colors.

25. The plasma display panel of claim 23, wherein the third chromatic color is near black.

26. The plasma display panel of claim 22, wherein a brightness of the first chromatic color is greater than a brightness of the second chromatic color.

27. The plasma display panel of claim 22, wherein the dielectric layer is entirely colored.

28. The plasma display panel of claim 22, wherein only upper portions of the plurality of barrier ribs are colored.

29. The plasma display panel of claim 22, wherein the plurality of barrier ribs are entirely colored.

30. The plasma display panel of claim 22, wherein the dielectric layer is arranged between the front substrate and the plurality of barrier ribs.

31. The plasma display panel of claim 22, wherein at least a portion of the plurality of light absorbing layers is arranged to correspond to the plurality of barrier ribs.

32. The plasma display panel of claim 22, wherein the plurality of light absorbing layers are arranged in stripes.

33. The plasma display panel of claim 22, wherein the plurality of light absorbing layers are near black.

34. The plasma display panel of claim 22, wherein the plurality of light absorbing layers are arranged within the dielectric layer.

35. The plasma display panel of claim 22, further comprising a plurality of X electrodes and a plurality of Y electrodes arranged on the front substrate and covered by the dielectric layer.

36. The plasma display panel of claim 35, wherein the plurality of X electrodes and the plurality of Y electrodes are alternately arranged.

37. The plasma display panel of claim 35, further comprising:

a plurality of address electrodes arranged between the front and the rear substrates and intersecting the plurality of X electrodes and the plurality of Y electrodes; and a plurality of fluorescent layers arranged within a plurality of discharge cells defined by the plurality of barrier ribs.

38. The plasma display panel of claim 35, wherein each X electrode comprises a first transparent electrode and a first bus electrode electrically connected to the first transparent electrode, and each Y electrode comprises a second transparent electrode and a second bus electrode electrically connected to the second transparent electrode.

39. The plasma display panel of claim 38, each X electrode further comprises a first project electrode that is transparent and extends from the first transparent electrode toward the second transparent electrode and each Y electrode further comprises a second project electrode that is transparent and extends from the second transparent electrode toward the first transparent electrode.

40. The plasma display panel of claim 38, wherein the first and the second transparent electrodes each comprise indium tin oxide.

41. The plasma display panel of claim 38, wherein each of the first bus electrodes and each of the second bus electrodes comprise a material selected from the group consisting of Ag, Cr, Cu, and Al.

42. The plasma display panel of claim 22, wherein the plurality of barrier ribs are a matrix type.

43. A plasma display panel, comprising:

a front substrate;

an X electrode and a Y electrode arranged in pairs on the front substrate;

a plurality of light absorbing layers arranged on the front substrate;

a dielectric layer arranged to cover the X and Y electrodes and the plurality of light absorbing layers;

a rear substrate arranged to face the front substrate;

a plurality of address electrodes arranged on the rear substrate and intersecting the X and Y electrodes;

a plurality of barrier ribs arranged between the front and the rear substrates;

a plurality of light absorbing layers arranged between the front substrate and the plurality of barrier ribs; and a plurality of fluorescent layers arranged within a plurality of discharge cells defined by the plurality of barrier ribs, the dielectric layer comprising an optically semi-transparent material adapted to filter out only a first color of light from an incoming beam, the plurality of barrier ribs comprising an optically semi-transparent material adapted to filter out only a second color of light from the incoming beam.

44. The plasma display panel of claim 43, the first and the second colors being complementary colors of each other.

45. The plasma display of claim 43, the first color being blue and the second color being orange.

46. The plasma display panel of claim 43, wherein at least a portion of the plurality of light absorbing layers is arranged to correspond to the plurality of barrier ribs.

47. The plasma display panel of claim 43, wherein the plurality of light absorbing layers are arranged in stripes.

48. The plasma display panel of claim 43, wherein the plurality of light absorbing layers are near black.

* * * * *